US006125082A

United States Patent [19]

Reid

[11] Patent Number: 6,125,082

[45] Date of Patent: Sep. 26, 2000

[54] TIMED CIGARETTE DISPENSER

[76] Inventor: Adonis M. Reid, 11980 Olmstead Dr., Fayetteville, Ga. 30214

[21] Appl. No.: 09/059,856

[22] Filed: Apr. 14, 1998

[51] Int. Cl.[7] ..... G04B 47/00; A24F 15/00; B65B 59/00; G07F 11/00

[52] U.S. Cl. ..... 368/10; 131/270; 206/249; 221/2; 221/15; 221/88; 221/255

[58] Field of Search ..... 368/10, 278; 131/270; 206/242, 249, 253; 221/2, 15, 27, 78, 87, 88, 151–154, 255–257, 281

[56] References Cited

U.S. PATENT DOCUMENTS

| | | | |
|---|---|---|---|
| D. 115,781 | 7/1939 | Christensen . | |
| D. 119,011 | 2/1940 | Rosenzweig . | |
| D. 298,574 | 11/1988 | Long et al. . | |
| D. 335,819 | 5/1993 | Campbell . | |
| 2,649,753 | 8/1953 | Doye, Jr. . | |
| 2,812,851 | 11/1957 | Kinnebrew . | |
| 3,424,123 | 1/1969 | Giffard . | |
| 3,999,412 | 12/1976 | Boroski et al. . | |
| 4,076,118 | 2/1978 | Karlsson . | |
| 4,615,681 | 10/1986 | Schwartz | 131/270 |
| 4,620,555 | 11/1986 | Schwartz | 131/270 |
| 4,862,431 | 8/1989 | Drouin . | |
| 5,203,472 | 4/1993 | Levenbaum et al. | 221/15 |
| 5,269,328 | 12/1993 | Gasparics . | |
| 5,405,045 | 4/1995 | Usmani | 221/7 |
| 5,566,855 | 10/1996 | Bradach | 221/15 |

FOREIGN PATENT DOCUMENTS

| | | |
|---|---|---|
| 2660839 | 10/1991 | France . |
| 3842817 | 9/1990 | Germany . |

*Primary Examiner*—Vit Miska
*Attorney, Agent, or Firm*—Dennis H. Lambert

[57] ABSTRACT

A timed cigarette dispenser for limiting the number of cigarettes available to a smoker to assist the smoker in reducing the number of cigarettes smoked over an interval of time, and/or to assist the smoker in quitting smoking. The dispenser includes a housing having a storage chamber therein for containing a quantity of cigarettes, and a solenoid operative to extend a plunger to engage a single cigarette and eject it partially from the housing where it may be grasped and withdrawn. An electronic timing circuit is connected with the dispensing solenoid to energize the solenoid upon the expiration of predetermined time intervals. A cover is latched closed over the storage compartment to prevent access to the storage compartment except when the storage compartment is empty. When the storage compartment is empty, a latch solenoid is automatically energized to disengage the latch and permit the cover to be opened. The device includes a liquid crystal display for displaying messages, and a keypad for entering different messages and/or setting different time intervals on the timer.

19 Claims, 12 Drawing Sheets

FIG. 1
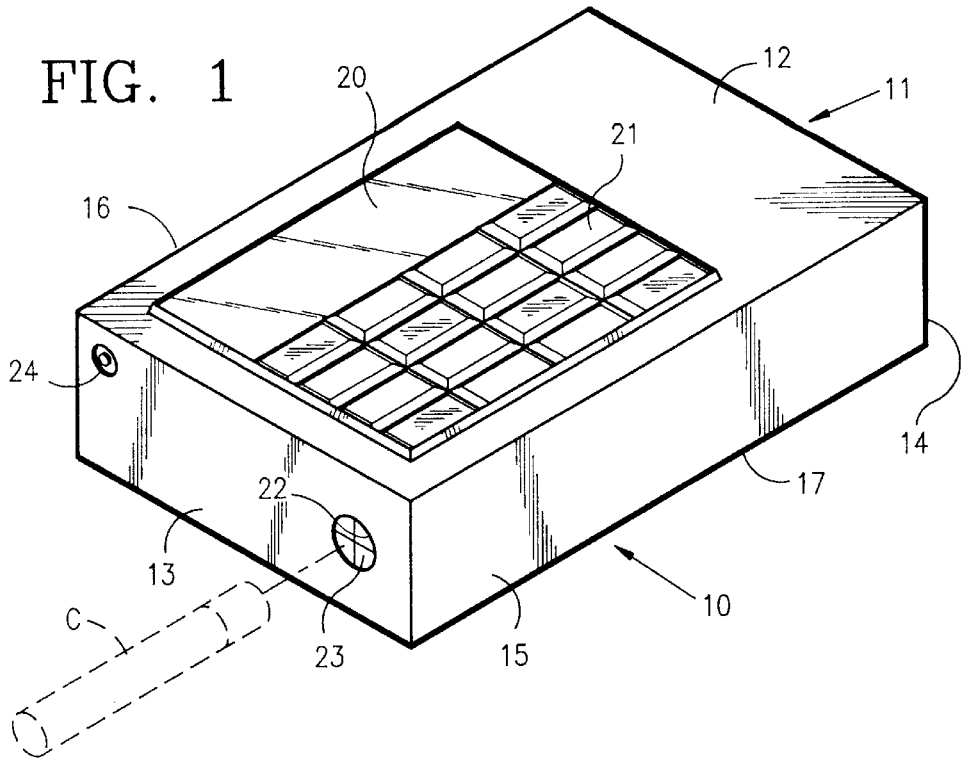
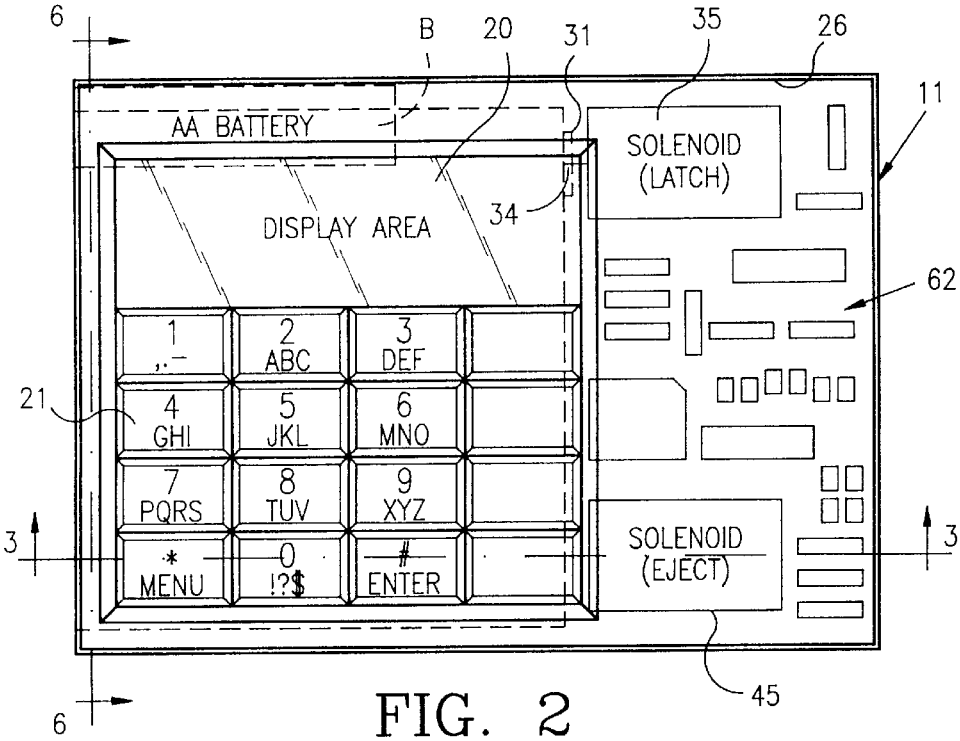
FIG. 2

Electronic System Block Diagram 62

Operator Interface Module

Generalized Context Block Diagram

Generalized Mechanical Functional Block Diagram

Generalized Electrical Functional Block Diagram

TIMED CIGARETTE DISPENSER

BACKGROUND OF THE INVENTION

1. Field of the Invention

This invention relates to devices for limiting the consumption of objects. More particularly, the invention relates to a cigarette case with means to control the timed dispensing of cigarettes for helping a smoker control the number of cigarettes consumed in a predetermined period of time, and to thereby assist the smoker in reducing the number of cigarettes smoked and/or to quit smoking.

2. Prior Art

The health risks associated with smoking cigarettes and other tobacco products are well known. Additionally, there is a substantial economic cost to individuals and to society as a whole resulting from addiction to smoking cigarettes. Because of the health risks and economic costs, many people desire to quite smoking, but find it very difficult due to psychological and physiological dependency associated with cigarette smoking.

A variety of devices and methods have been developed in the prior art for assisting people in their efforts to quit smoking. These prior art devices and methods include hypnosis, chewing gum, patches applied to the skin, and containers for holding a quantity of cigarettes and dispensing them only at timed intervals. Timed dispensing of cigarettes can be particularly useful in overcoming both habitual smoking and chemical dependency on cigarettes.

Habitual smokers associate the smoking of a cigarette with various activities, and whenever the person engages in that activity, he or she tends to light a cigarette almost reflexively. Since these activities may be common events that occur frequently during a routine day, many persons smoke a large number of cigarettes purely out of habit by consciously or subconsciously associating smoking with the activity. Habitual smoking may therefore be controlled by disassociating the smoking of a cigarette from the activity. Controlled or timed dispensing of cigarettes can be effective in doing this because availability of a cigarette can be withheld during the activity until the habit is overcome.

Chemical dependency is more difficult to overcome. As with all chemical addictions, it is very difficult to cease consumption all at once. Cessation of smoking produces powerful cravings that are likely to result in the resumption of the addictive behavior. However, chemical dependency may be controlled by a gradual withdrawal that produces more tolerable side effects.

The control of both habitual and chemically addictive smoking requires the exercise of great will power, particularly without the aid of some external device, and a deliberate and conscious effort must be made to not smoke a cigarette whenever the desire occurs, whether from habit or chemical addiction. Unfortunately, the very act of concentrating on the effort to stop smoking places the act of smoking almost constantly in the person's thoughts, which itself can lead to a greater desire to smoke.

Thus, devices which limit the availability of cigarettes can obviate the need to constantly be thinking about smoking in an effort to resist the desire to smoke a cigarette. Devices which have been developed in the prior art for the timed dispensing of cigarettes are exemplified in U.S. Pat. Nos. 2,649,753, 2,812,851, 3,424,123, 4,076,118 and 4,862,431.

U.S. Pat. No. 2,649,753 discloses a cigarette case having a timing indicator on its outer surface which may be reset each time the case is opened to indicate a time at which a cigarette may be smoked. Thus, each time a person opens the case to retrieve a cigarette, he or she resets the timing indicator to a selected future time at which a subsequent cigarette may be smoked. However, there is nothing to prevent the person from opening the case and retrieving one or more cigarettes at any time the person desires, or from retrieving more than one cigarette when the proper time has elapsed. The timing indicator is merely a visual reminder that a preset time has not yet been reached.

U.S. Pat. No. 2,812,851 discloses a time-controlled cigarette case having a plurality of cigarettes contained therein in individual compartments closed by a movable cover that is retracted to sequentially uncover the compartments in a timed sequence as determined by a timing mechanism. Only one cigarette may be retrieved at a time from this device, but the timing mechanism may be adjusted to a faster setting so that the individual compartments are uncovered more rapidly than may have been originally desired. Thus, a person could initially intend to have a cigarette available only every two hours, for example, and set the timing mechanism accordingly. However, if the person becomes impatient, it is possible to reset the timer so that a subsequent cigarette becomes available more quickly. This at least partially defeats the purpose of the device.

U.S. Pat. No. 3,424,123 describes a cigarette case which has a timing mechanism and an audible signalling device that emits a signal upon the elapse of a preselected time interval to indicate to a person that a cigarette may now be withdrawn and smoked. There is nothing in this patent that prevents the person from gaining access to the cigarettes in the case, but relies instead upon the person exercising will power to avoid lighting a cigarette until the expiration of the preset time interval. Moreover, it is possible for the user to reset the time to shorter time intervals, if desired.

U.S. Pat. No. 4,076,118 discloses a device for timed dispensing of cigarettes, in which the cover remains locked until elapse of a predetermined time interval, thereby preventing access to the cigarettes until the predetermined time has expired. However, access to the entire contents of the case is possible when it is opened, whereby multiple cigarettes may be withdrawn, defeating the purpose of the timing mechanism.

U.S. Pat. No. 4,862,431 discloses a cigarette case with an electronic timing device which causes a pleasing sound to be emitted when a predetermined time interval has elapsed, to indicate to the person that it is permissible to open the case and retrieve a cigarette. If an effort is made to open the case prematurely, an irritating sound is emitted. However, it is possible for a person to open this device at any time to retrieve one or more cigarettes, thereby defeating it.

Accordingly, there is need for a dispensing device for cigarettes which permits access to only one cigarette at a time, and which prevents access to a cigarette until a preset time interval has elapsed, and which prevents the smoker from resetting the time intervals to shorter times once they have been set.

SUMMARY OF THE INVENTION

The present invention provides a timed cigarette dispenser which permits access to only one cigarette at a time, and which may be programmed to electronically set dispensing time intervals that are intended to gradually "wean" the smoker from cigarettes. The time cannot be reset to shorter time intervals after the dispenser has been loaded with cigarettes and a time interval selected, thereby preventing a smoker from re-setting time intervals to more frequently access the cigarettes.

The timed cigarette dispenser of the invention includes a video display that may be programmed to display a variety of anti-smoking messages. A keypad on the dispenser is connected with internal electronic circuitry to create displays and to enter a set time interval or a sequence of gradually increasing time intervals for dispensing cigarettes one at a time from the dispenser.

A storage compartment in the dispenser is adapted to receive a full pack of cigarettes, and a cover is movable into closed position over the compartment. A latch engages the cover to hold it closed until all of the cigarettes have been dispensed from the storage compartment, so that only one cigarette may be withdrawn at the appropriate time.

A dispensing chamber at one side of the storage compartment is adapted to receive and hold a single cigarette in a position to be dispensed, and a dispensing solenoid is operative to move a plunger to eject the cigarette from the dispensing chamber and through a dispensing opening in the dispenser housing upon elapse of a predetermined time interval entered into the timer circuit via the keypad.

A latch solenoid is connected with the latch to disengage the latch and enable the cover to be opened only when all of the cigarettes have been dispensed from the storage compartment and dispensing chamber.

The timed cigarette dispenser of the invention may be battery operated for portable operation, or it may be operated via an adaptor plugged into a cigarette lighter receptacle in a vehicle, or a normal electrical outlet in an office or dwelling.

A person desiring to quite smoking can utilize the timed cigarette dispenser of the invention to gradually overcome the psychological and physiological desire for a cigarette. The ability to program different time intervals into the dispenser for dispensing cigarettes enables a light smoker to program in longer times between cigarette dispensing cycles, whereas a heavy smoker can initially program in shorter time intervals. Further, the time intervals may be set to remain constant throughout a plurality of dispensing cycles, or the time intervals may be programmed to gradually increase in length as cigarettes are sequentially dispensed. Once a predetermined time interval is set, however, it cannot be shortened. Moreover, a person using the dispenser of the invention has access to only a single cigarette at the end of a selected time interval.

The circuit of the invention includes a main microprocessor that acts as the main controller, sets up the real-time clock, calculates when the next cigarette should be dispensed, sounds a beeper, and energizes a solenoid to dispense a cigarette. The main microprocessor also energizes a solenoid that controls the cover latch when the storage compartment is empty, sends random messages to the video display, reads input from the keypad, and interfaces the rest of the microchips in the circuit. These microchips include EPROM memory that stores the controller sequencing and instructions in read-only memory (ROM). This microchip may be included in the main microprocessor microchip. A FLASH memory microchip stores in read/write non-volatile memory dynamic information such as whether the system is in a manual or a preprogrammed automatic mode of operation, the amount of time to the next dispensing cycle, and, messages about the hazards of smoking and the benefits of quitting. This microchip may also be included in the main microprocessor microchip.

The real-time clock keeps track of time and interrupts the main microprocessor when the next action is required. The real-time clock may also be included in the main microprocessor microchip.

The dispensing solenoid has a normally retracted plunger that is extended upon energization of the solenoid to engage a cigarette and push it partially from the dispensing chamber, where it may be grasped by the smoker and withdrawn from the dispenser. The latch solenoid is normally extended to engage and hold the latch member on the cover to latch the cover closed. Upon energization, the latch solenoid withdraws its plunger from the latch member to free the cover so that it can be opened.

The circuit may also include a beeper that receives a signal from the microprocessor to produce an audible signal to alert the smoker that the next cigarette is ready or that the storage compartment is empty.

The video display comprises a liquid crystal display (LCD) in a two-line by twenty character alpha-numeric array that shows the time and gives messages of the hazards of smoking and the benefits of quitting. The keypad is connected with the circuit and the display, and includes a 3×4 matrix of twelve push buttons to allow the operator to enter information into the microprocessor and FLASH memory.

When the power input cord is not connected, batteries provide electrical energy to power the microchips, the display, the beeper, the solenoids, and other components. A power input jack is provided for accepting power from a standard AC wall adaptor, or from an automobile cigarette lighter adapter, to charge the batteries and to power the dispenser when not being used in its portable mode.

The dispenser of the invention can have any shape and size desired. However, it preferably resembles a normal cigarette case in appearance, measuring approximately one inch by three and one-half inches by five inches. All electronic components are selected for minimum power consumption to extend battery life as long as possible. Suitable batteries may include standard alkaline or lithium batteries having approximately a one year life. Optionally, the batteries may be rechargeable nickel cadmium batteries, and may be recharged approximately monthly.

With batteries installed or the power adaptor plugged into a source of electrical energy, if the storage compartment is empty, the cover will be unlatched and open. A full pack of cigarettes may then be loaded into the storage compartment. The cover automatically locks in its closed position, without the use of a key, and cannot be opened until the compartment is empty.

The dispenser will dispense cigarettes according to a programmed sequence. The smoker can choose either a manual program sequence or an automatic program sequence by using the keypad. The smoker will be guided through a series of menu messages for either sequence, and can enter preferences through the keypad.

In its manual program mode, the time between cigarettes can be set after each cigarette is dispensed. In this mode, the microprocessor will display a message asking the smoker how long a time is desired between cigarettes. Based upon the answer, the microprocessor will set the timer to dispense a cigarette only at the selected intervals. Each time a cigarette is dispensed, the smoker can lengthen the time or leave it the same. Thus, when the smoker withdraws a cigarette, he or she can then enter the time to the next cigarette. The time can only be increased or left the same as it was the last time a cigarette was dispensed. It cannot be decreased. If no new time is entered, the time will remain the same as the last time. If the smoker is going to sleep, or an extended time is going to pass before the smoker retrieves another cigarette, the smoker can enter a special long "sleep" time, and afterwards resume the normal time between cigarettes.

In the automatic pre-programmed mode, the time between cigarettes is automatically set by the microprocessor. The smoker can choose, e.g., a four-week or eight-week or twelve-week time to quit, and the microprocessor will calculate the time between cigarettes necessary to accomplish this goal. Thus, if the smoker chooses the automatic pre-programmed mode, the microprocessor will display a message on the screen asking the smoker how many more weeks he or she wants to smoke. Based upon the answer, e.g., such as six weeks, and how much they smoke now, e.g., such as heavy, the microprocessor will calculate how many cigarettes should be dispensed each day, and how much time should elapse between each cigarette. For example, for the fist day for a heavy smoker, the microprocessor may start dispensing a cigarette every hour, and by the end of the day it may be dispensing a cigarette only every hour and fifteen minutes. Each time a cigarette is dispensed, the time may be lengthened slightly according to the preprogrammed sequence.

Whenever a cigarette is dispensed, in either mode, the timer will stop until the cigarette is withdrawn, and then the time will begin for the next cigarette to be dispensed. A beeper may also sound to indicate to the smoker that the preset time interval has elapsed, and that a cigarette is ready to be withdrawn. If the smoker is asleep or cannot have a cigarette at that time, the microprocessor will stop the timer and will not send a signal to the dispensing solenoid to dispense another cigarette until the previously dispensed cigarette has been withdrawn.

Cigarettes in the storage compartment are moved toward the dispensing chamber, where a single cigarette is stored in a position ready to be dispensed upon elapse of the preset time interval. Movement of the cigarettes through the storage compartment to the dispensing chamber is accomplished by a constant velocity spring engaged with a follower that moves through the storage compartment to urge the cigarettes toward the dispensing chamber. When the last cigarette is withdrawn, the follower closes a contact to energize the latch solenoid to unlatch the cover.

If desired, a speaker may be provided to generate audible messages to the smoker. However, this option would require a slightly larger dispenser housing, and would also consume more power and be more expensive to make and use.

During normal operation of the dispenser according to the invention, only the real-time clock and the LCD display are running. The remainder of the microchips and electronics are powered down to conserve battery life. The clock interrupts the microprocessor when the next activity is required, or the smoker can interrupt the microprocessor to enter program information. However, the smoker cannot override the real-time clock. Before powering down, the microprocessor sets an alarm in the real-time clock to interrupt when the next cigarette should be dispensed, then powers down itself and all other electronics. Later, when the interrupt occurs, the microprocessor powers up the electronics, sounds the beeper for a predetermined time, and applies power to the dispensing solenoid to dispense a cigarette. When the smoker withdraws the cigarette, the microprocessor permits the smoker to increase the time interval between cigarettes, or to leave the time interval the same, and then sets the real-time clock alarm for the time to dispense the next cigarette. The microprocessor then again shuts down the power.

Messages are periodically shown in the LCD. Several standard prerecorded messages are available. Optionally, the smoker can enter his or her own set of messages, or use a combination of standard and custom messages. The messages can be shown in sequence or at random, as chosen by the smoker. A set of menu commands are used to enter new messages and choose the sequence of display. The messages are displayed every time a cigarette is dispensed, or whenever the smoker tries to release a cigarette before the preset time has elapsed. The usual sequence is to display the hazards of smoking when a cigarette is dispensed, and to display the benefits of quitting when the cigarette is withdrawn and before it is time to have the next cigarette.

If the battery is low, a message will be displayed the next time the storage compartment is empty, telling the smoker to install a new battery. If the battery is dead, the dispenser can be connected to a standard AC wall outlet or an auto cigarette lighter socket via a power adaptor.

BRIEF DESCRIPTION OF THE DRAWINGS

The foregoing, as well as other objects and advantages of the invention, will become apparent from the following detailed description when considered in conjunction with the accompanying drawings, wherein like reference characters designate like parts throughout the several views, and wherein:

FIG. 1 is a top perspective view of a timed cigarette dispenser according to the invention;

FIG. 2 is a somewhat schematic top plan view of the dispenser of FIG. 1, showing the general location of the major components;

DETAILED DESCRIPTION OF A PREFERRED EMBODIMENT

Figure 3:
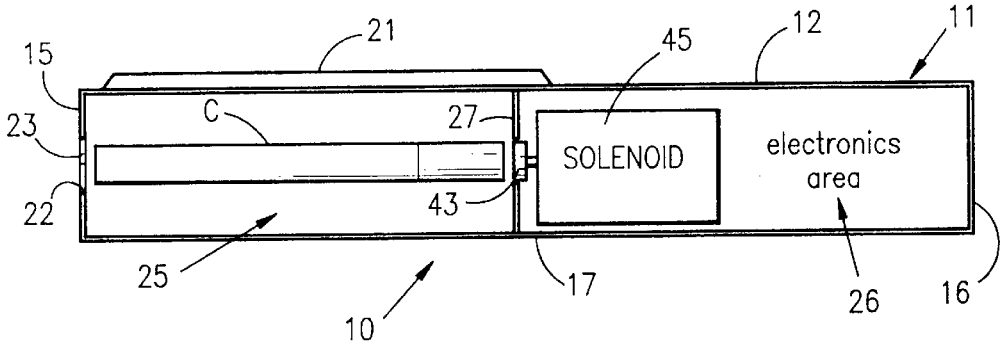
FIG. 3 is a longitudinal sectional view taken along line 3—3 in FIG. 2, showing the position of the dispensing solenoid plunger and a cigarette in the dispensing chamber in a position ready to be dispensed.
Figure 4:
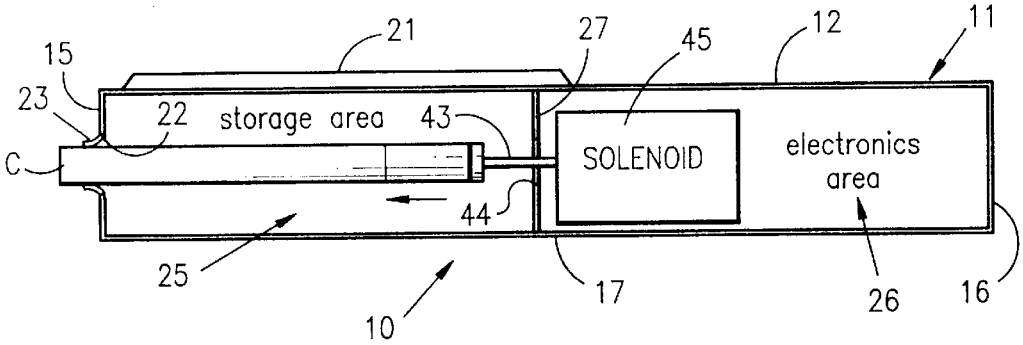
FIG. 4 is a longitudinal sectional view similar to FIG. 3, showing the dispensing solenoid plunger extended to eject a cigarette from the dispensing chamber to a position with one end exposed through the outside of the dispenser housing so that it may be grasped and withdrawn by the smoker.
Figure 5:
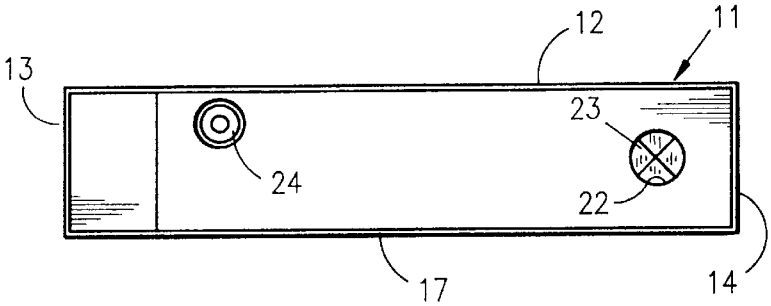
FIG. 5 is an end view in elevation of the dispenser, showing the approximate position of the dispensing opening and the power jack.
Figure 6:
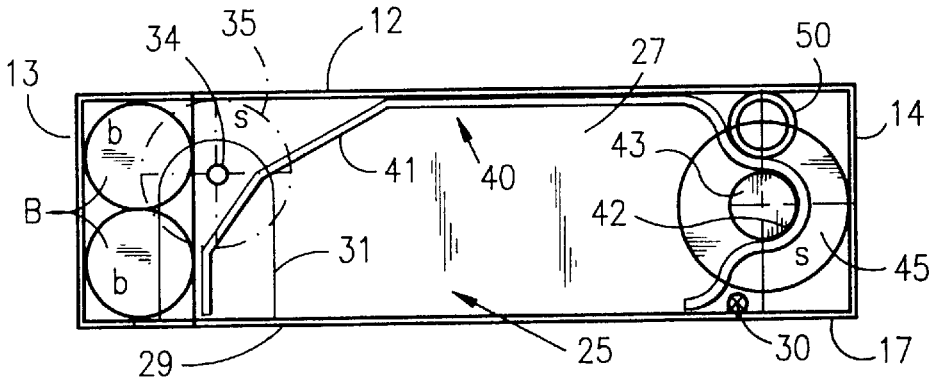
FIG. 6 is a somewhat schematic transverse sectional view taken along line 6—6 in FIG. 2, showing the cover in closed position, and showing the general location and arrangement of the batteries, cover latch, constant velocity spring, latch solenoid, dispensing solenoid, and storage compartment and dispensing chamber.
Figure 7:
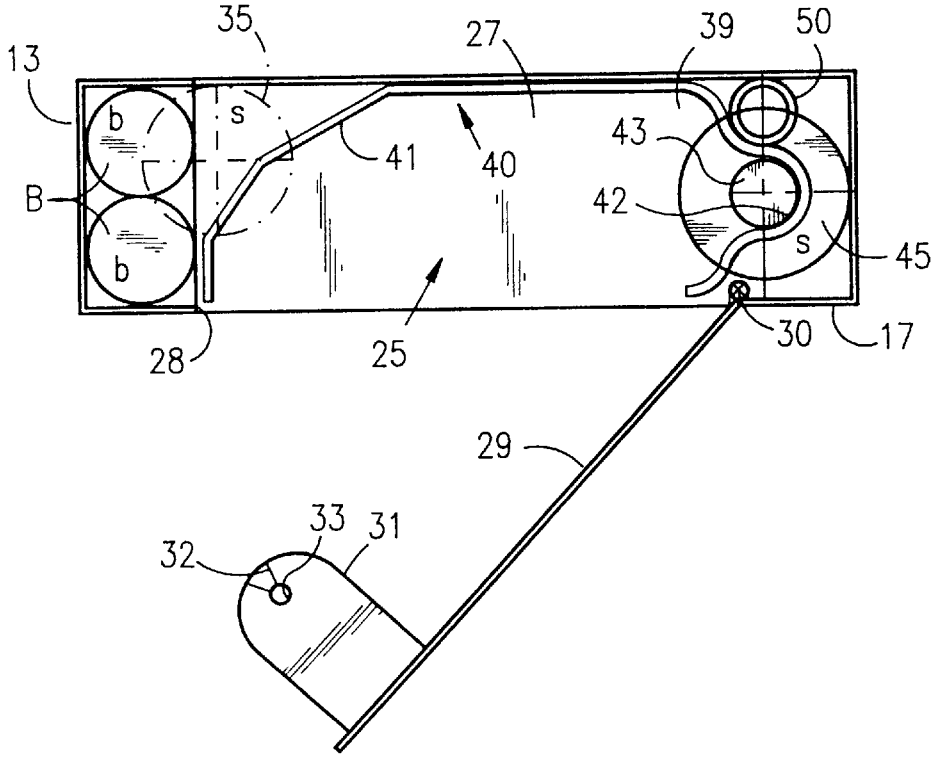
FIG. 7 is a view similar to FIG. 6 showing the cover in unlatched, open position.

The timed cigarette dispenser according to the invention is indicated generally at 10 in FIG. 1. The dispenser includes a generally rectangular housing 11 having a top wall 12, opposite end walls 13 and 14, front and back walls 15 and 16 and a bottom wall 17.

A liquid crystal display 20 and keypad 21 are provided in the top wall 12, and a dispensing opening 22 covered by a flexible closure 23 is provided in the end wall 13 near one end thereof. A suitable power jack 24 is also provided in the end wall 13 near its other end for connection with a suitable source of power.

As seen best in FIGS. 3–14, the interior of the housing is divided into a storage compartment 25 toward end wall 13 and an electronics compartment or area 26 toward opposite end wall 14. Transverse wall 27 separates the areas. The bottom wall 17 beneath storage compartment 25 has a large opening 28 in it, and an openable cover 29 is pivoted to the bottom wall 17 by hinge means 30 to cover and close the opening 28.

The cover 29 is maintained in its closed position by a latch member 31 having a guide channel 32 leading from an outer end thereof to an opening 33 for receiving the plunger 34 of a latch solenoid 35 mounted in the housing behind wall 27, in the electronics area 26. In the normal, de-energized state of solenoid 35, the plunger 34 is extended into the path of latch member 31, so that when the cover 29 is closed, the guide channel 32 receives the end of plunger 34 and guides it into opening 33 of latch member 31, to latch the cover closed until the solenoid is energized to retract the plunger from the opening 33 to release the latch member 31 and enable the cover to be opened.

A shaped storage compartment liner 40 is positioned in the storage compartment behind the opening 28 and against the inner surface of top wall 12, and includes a generally tapered or inclined end wall 41 at one end, and has a shaped dispensing chamber 42 at its other end, projecting beyond the location of the hinge 30 and shaped and sized for receiving a single cigarette C therein. A complementally shaped plunger 43 has a normal, at-rest position in an opening 44 formed through the wall 27 separating the electronics area 26 from the storage compartment 25. A dispensing solenoid 45 in the electronics area behind the wall 27 extends the plunger 43 when the solenoid is energized to engage the rearward end of a cigarette C and partially eject it from the dispensing chamber 42, with the forward end of the cigarette extended through the opening 22 and cover 23 so that it may be grasped to withdraw the cigarette from the housing.

The depth of the storage compartment, from wall 15 to wall 27, is great enough to accommodate king-size cigarettes, whereby all popular sizes of cigarettes may be placed in and dispensed from the timed cigarette dispenser of the invention.

Figure 8:
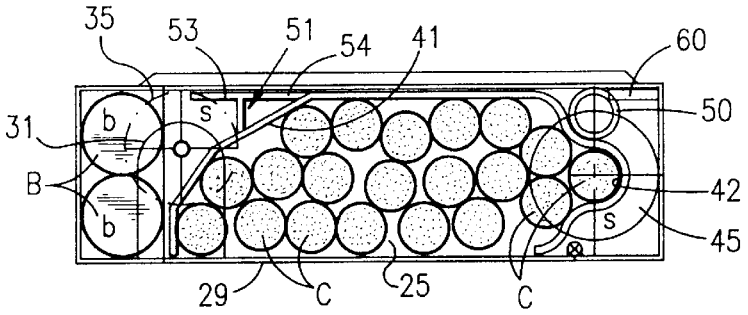
FIG. 8 is a view similar to FIG. 6, showing the storage compartment filled with cigarettes, and showing the spring follower at the left hand side of the storage compartment.
Figure 9:
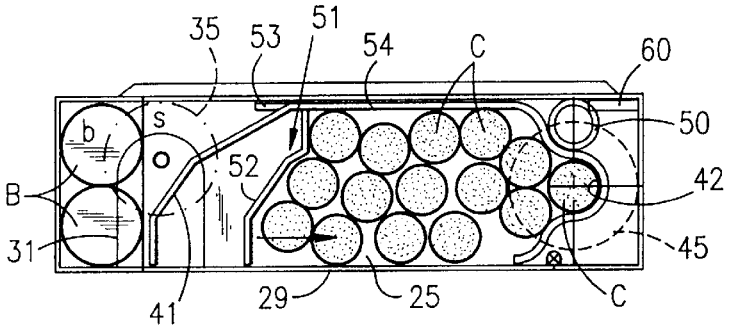
FIG. 9 is a view similar to FIG. 8, showing the spring follower moved toward the right to urge cigarettes toward and into the dispensing chamber to replace cigarettes previously withdrawn.

A constant velocity spring 50 and spring follower 51 are mounted in the storage compartment, with the spring 50 positioned behind and above the dispensing chamber 42, and the follower positioned at the other end of the storage compartment when it is full of cigarettes. The follower 51 includes oppositely extending guide flanges 53 and 54 that are adapted to be slidably received in an elongate slot 55 formed along the center of the liner 40 from approximately the middle of dispensing chamber 42 through the shaped end wall 41. An arm 52 that has the same general shape and configuration as the end wall 41 of the liner 40, except that is much narrower to fit into the slot 55, depends from the flanges. The follower 51 is connected to the constant velocity spring via an extended portion 50*a* of the spring, so that the spring exerts a pulling force on the follower 51 to pull it toward the dispensing chamber 42 to move the arm 52 across the storage chamber and thereby urge cigarettes toward and into the dispensing chamber. The guide flanges 53 and 54 slide along the inner surface of the top wall 12 of the housing, in the slot 55 of liner 40, and serve to maintain the follower in an upright position as depicted in FIGS. 8–10.

Figure 10:
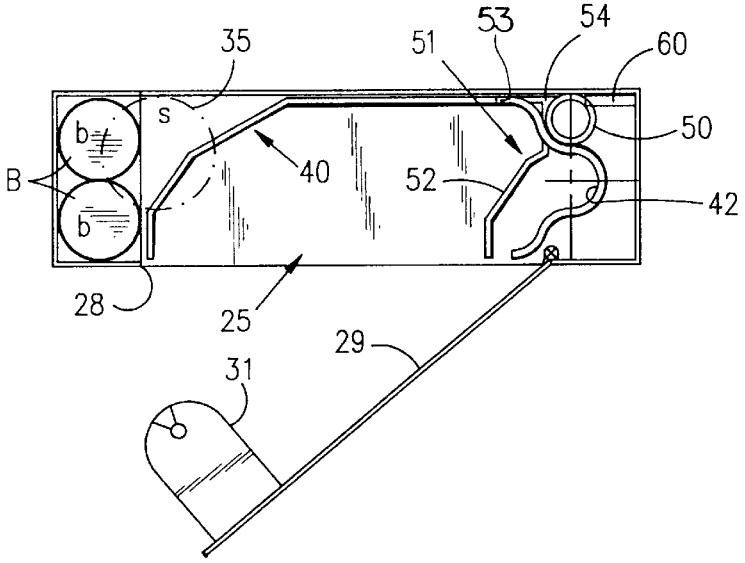
FIG. 10 is a view similar to FIG. 8, showing the storage compartment and dispensing chamber empty of cigarettes, with the spring follower moved all the way to the right to engage the contact to energize the latch solenoid and release the latch to open the cover.
Figure 12:
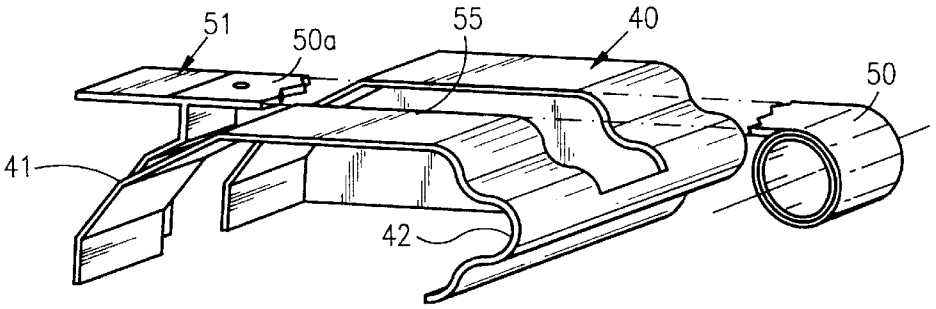
FIG. 12 is a fragmentary exploded perspective view of the storage compartment liner, and showing how the constant velocity spring and follower are received and guided in a slot formed in this liner.
Figure 14:
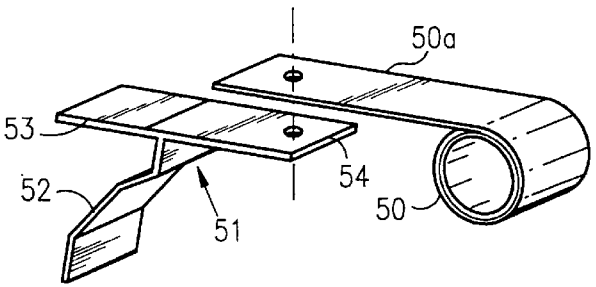
FIG. 14 is an exploded perspective view of the constant velocity spring and follower of FIG. 12.
Figure 11:
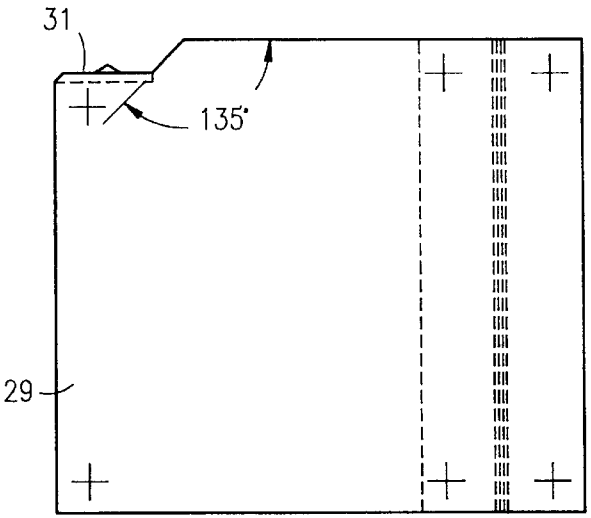
FIG. 11 is a bottom plan view of the cover, removed from the dispenser housing.
Figure 13:
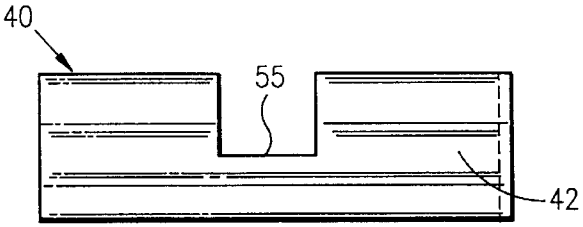
FIG. 13 is an end view in elevation of the storage compartment liner of FIG. 12.

When the storage compartment is empty of cigarettes, and the spring follower 51 has been moved all the way to the right, as shown in FIG. 10, by the spring 50, the flange member 54 engages a contact 60 in the housing to close the circuit and energize the latch solenoid 45 to release the latch and enable the cover 29 to open, so that the storage compartment can be replenished with cigarettes. Until this contact is established, the solenoid 45 remains de-energized and the cover 29 remains latched closed.

An electronic system 62 for controlling the various functions of the dispenser of the invention is contained within the electronics area 26.

The electronic system 62 of the invention may be broken down into four modules: the power input module 63, which includes the battery and power converter; the main microprocessor module 64, which includes the microprocessor itself, as well as the power monitor; the memory and clock module 65, which includes the flash memory and the real-time clock; and the operator interface module 66, which includes the liquid crystal display 20, the keypad 21, the latch solenoid 35, the dispensing solenoid 45, and beeper 46. All modules are preferably assembled on a common printed circuit board.

Figure 15:
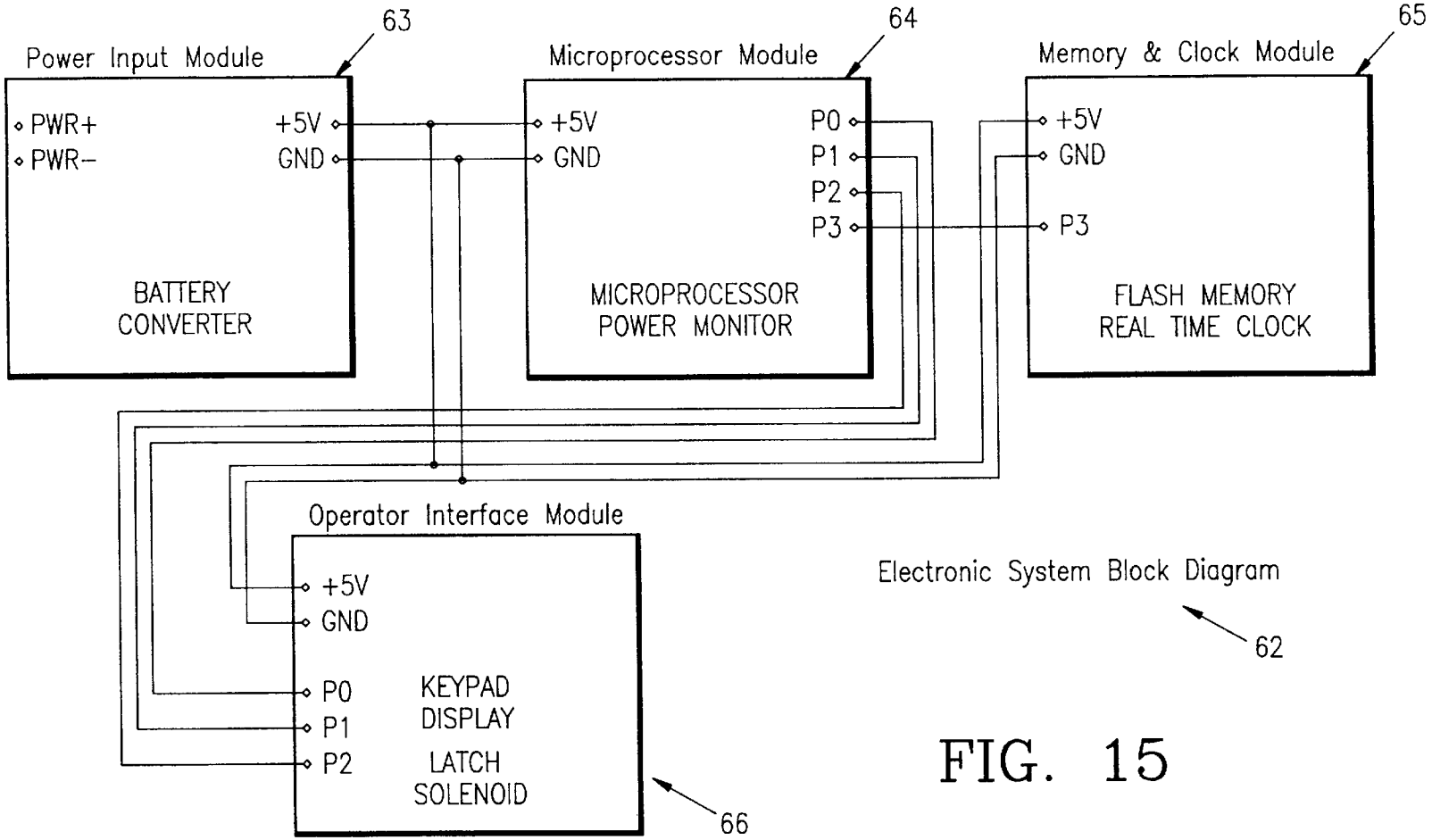
FIG. 15 is a schematic block diagram of the four electronic modules used in the timed dispenser of the invention.
Figure 16:
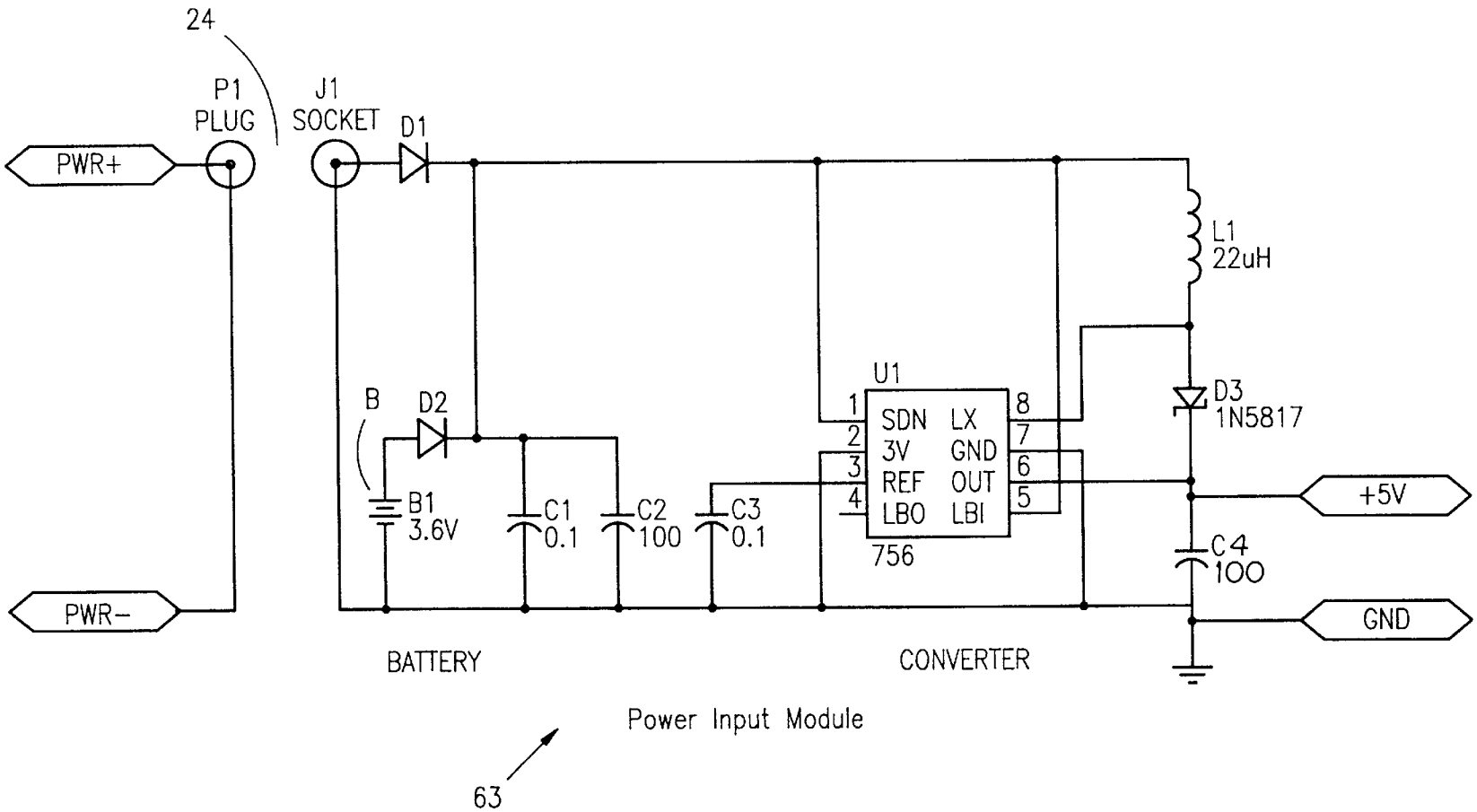
FIG. 16 is a schematic electrical diagram of the power input module.
Figure 17:
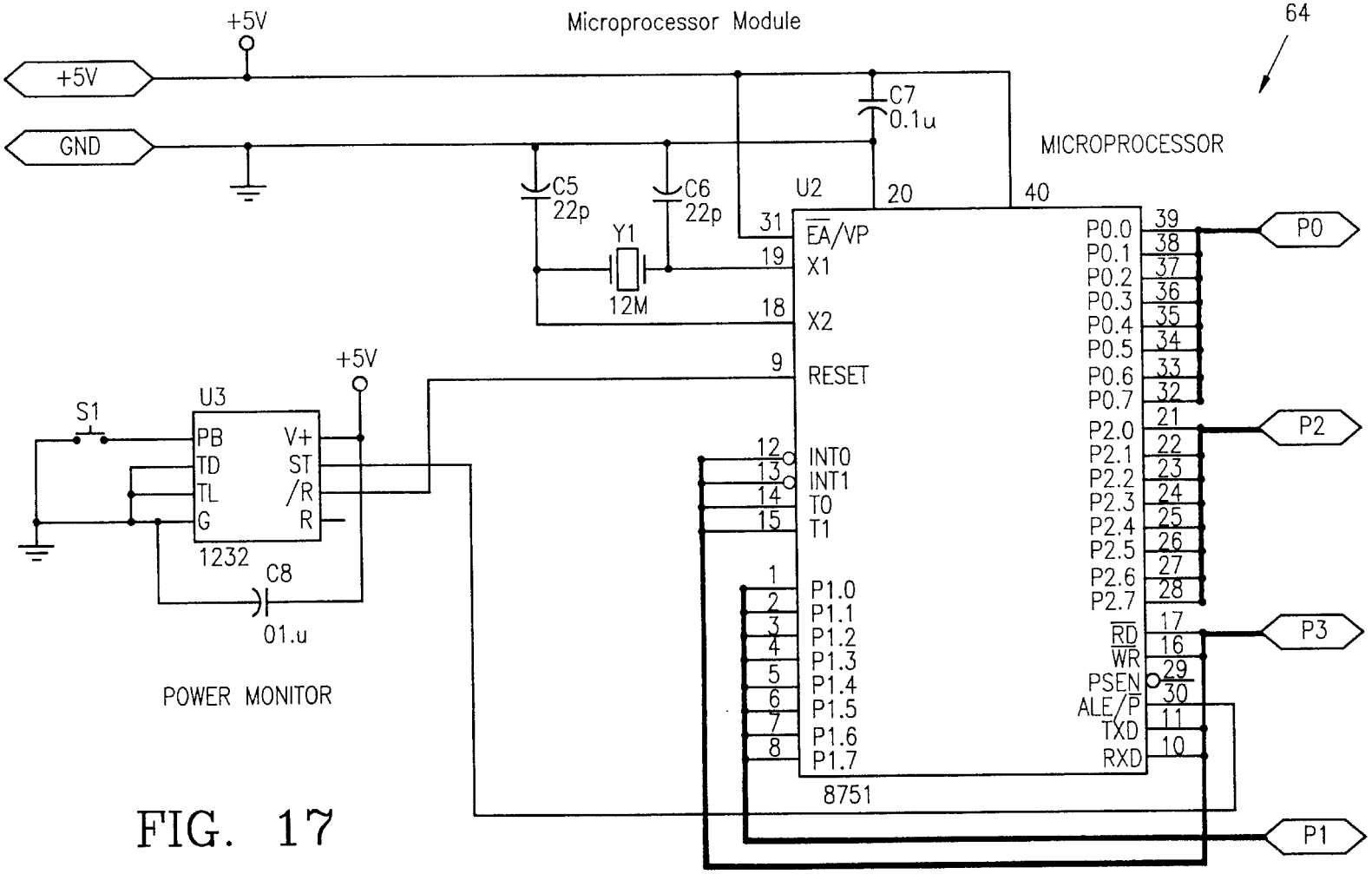
FIG. 17 is a schematic electrical diagram of the main microprocessor module.
Figure 18:
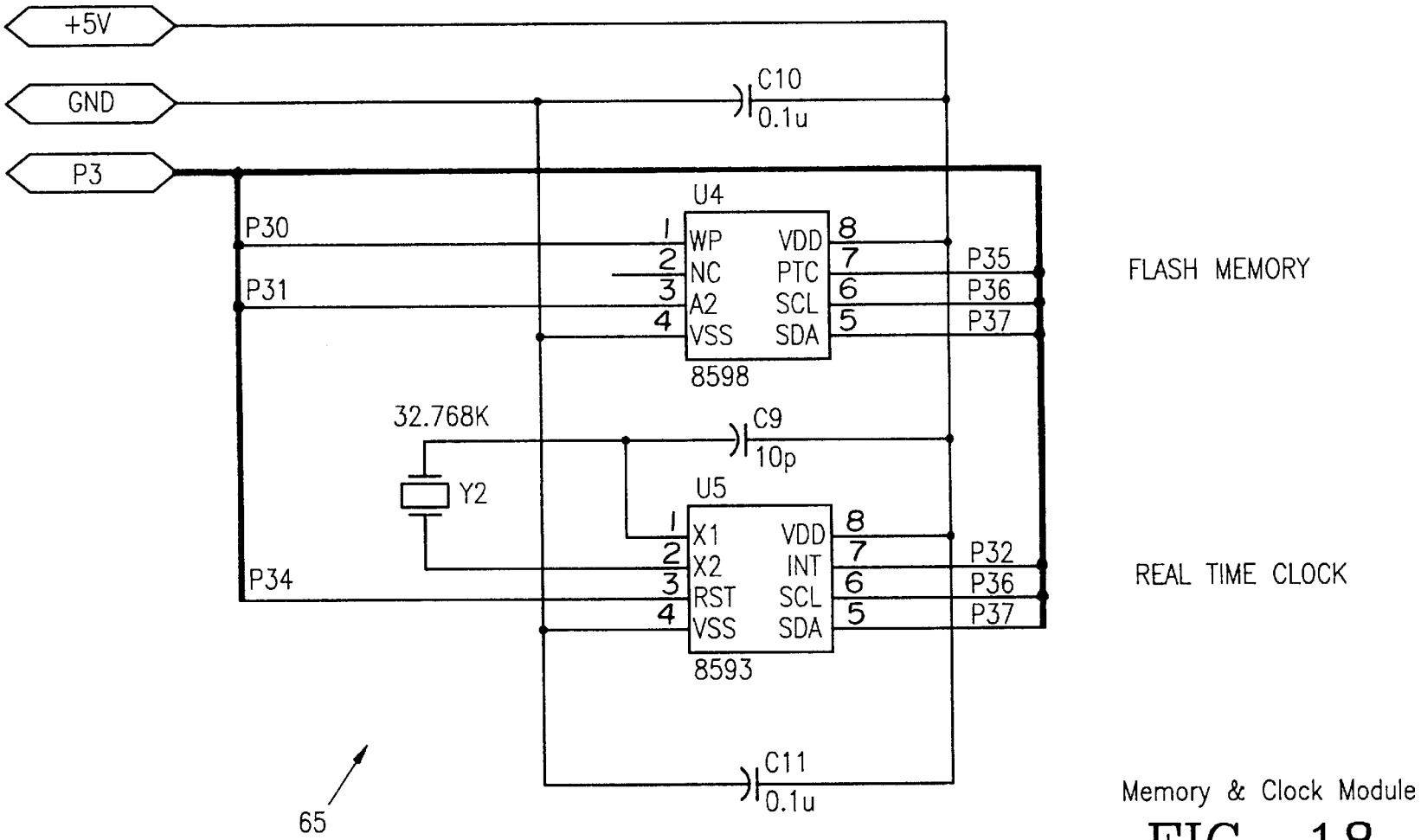
FIG. 18 is a schematic electrical diagram of the memory and clock module.
Figure 19:
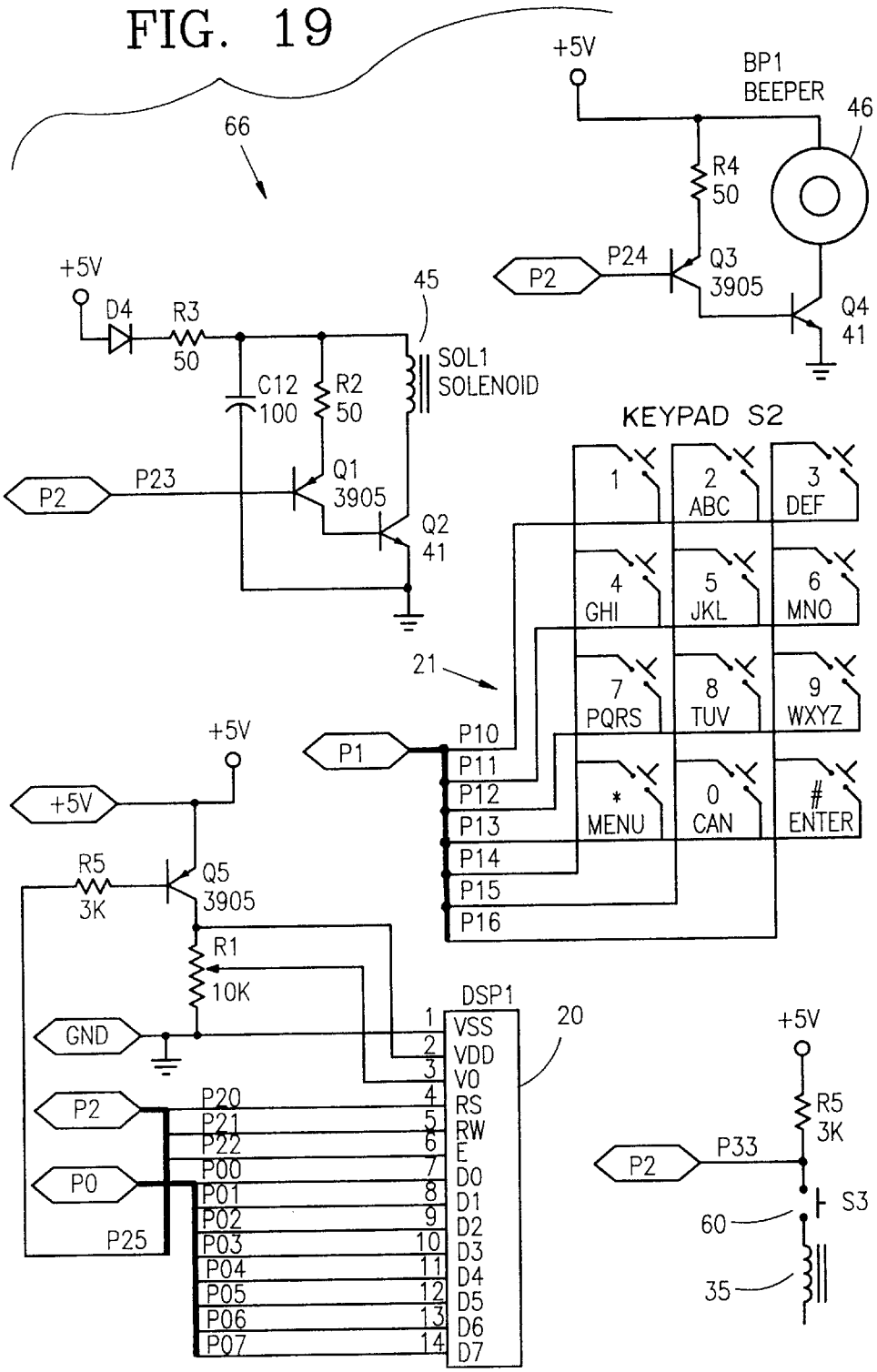
FIG. 19 is an exploded schematic electrical diagram of the electronic circuit components of the operator interface module.
Figure 20:
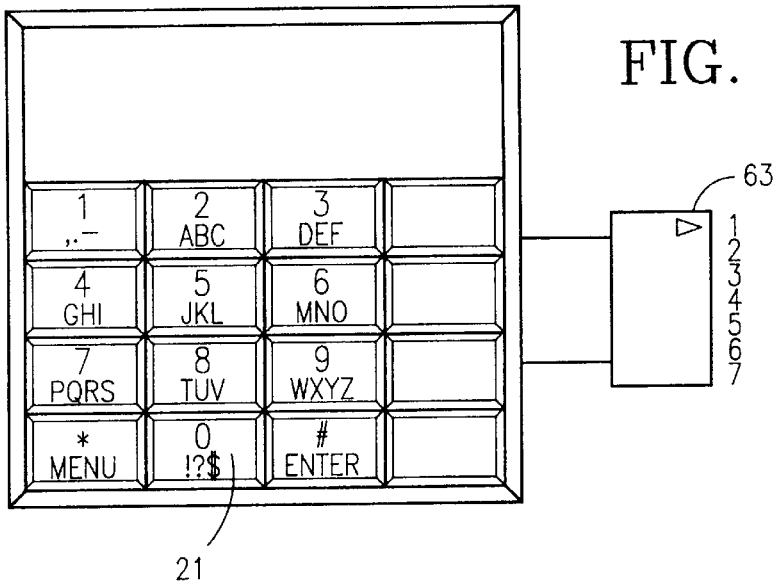
FIG. 20 is a top plan view of the keypad and connector for mating with the operator interface module.
Figure 21:
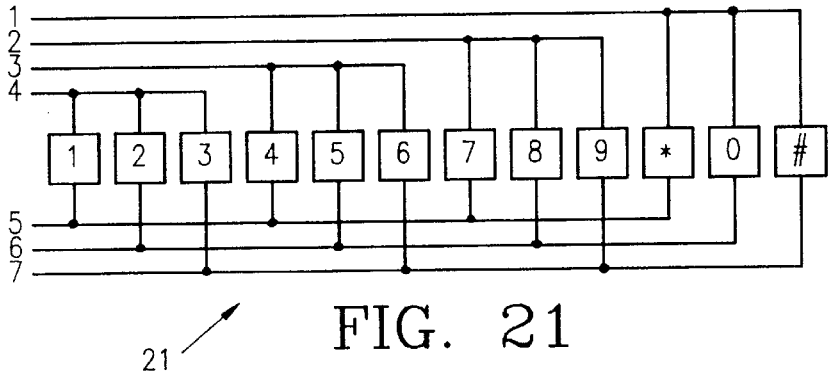
FIG. 21 is a schematic wiring diagram of the connection of the touch buttons on the keypad with the operator interface module.
Figure 22:
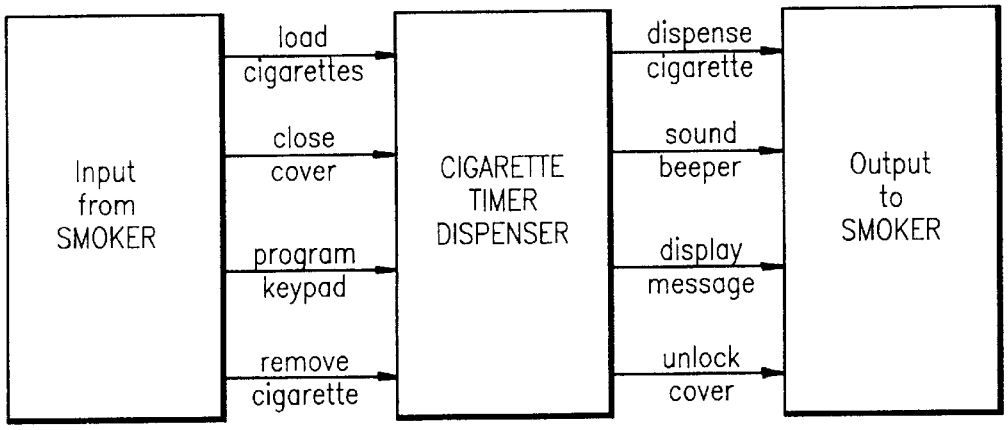
FIG. 22 is a schematic block diagram depicting the principal operational steps of the invention.
Figure 23:
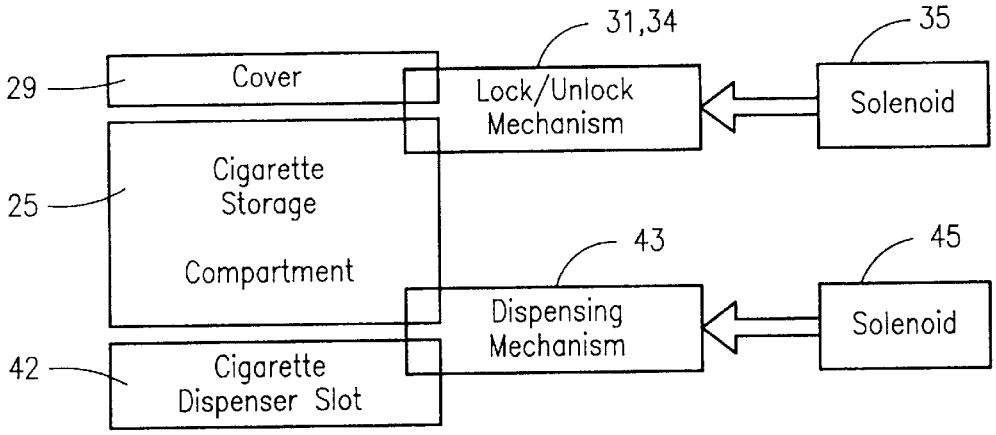
FIG. 23 is a schematic block diagram depicting the principal mechanical functions of the invention.
Figure 24:
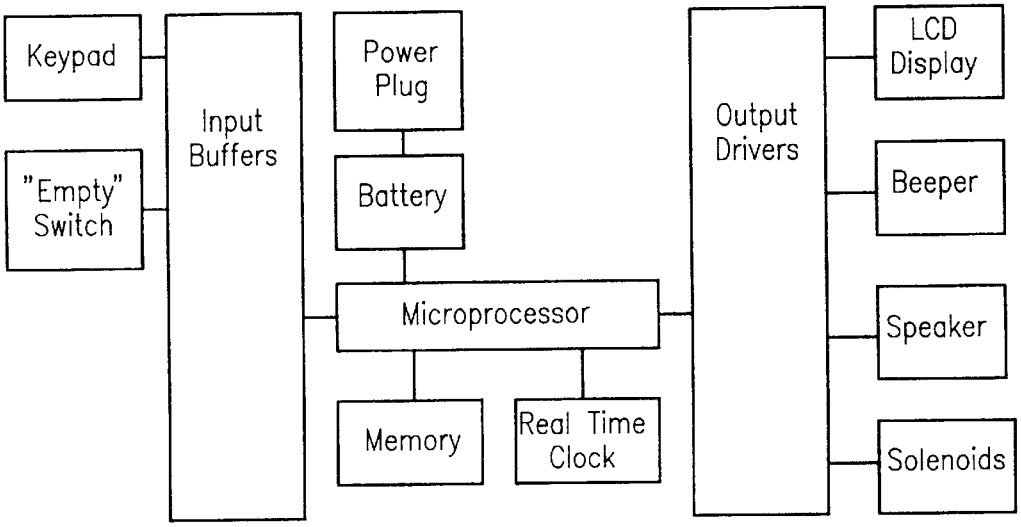
FIG. 24 is a schematic block diagram depicting the major electrical components of the invention.

Regulated five volt power for the dispenser is developed in the power input module 63. Either batteries B or a plug-in adaptor (not shown) provides electrical energy to the system. If no adaptor is plugged in, the unit will operate from the batteries B. If the system is supplied with energy from the batteries B, energy flows through diode D2 and is blocked by diode D1. Alternatively, if an adaptor (not shown) is plugged into the port 24, energy flows through diode D1 and is blocked by diode D2. Capacitors C1 and C2 provide energy storage and reduce transients on the supply. A voltage converted U1 boosts and regulates the output voltage to five volts by means of the inductor L1 and diode D3. Capacitor C3 provides energy storage for the regulated five volt output supply voltage. This regulated output is then distributed to the other two modules as shown in FIG. 15.

The main microprocessor module 64 includes four input and output ports P0, P1, P2 and P3, which communicate with the flash memory and clock module 65 and the operator interface module 66. The four ports of the microprocessor provide up to 32 input and output lines for communicating with the other control modules. Port P3 connects to the memory and clock module, and ports P0, P1 and P2 connect to the remaining functions on the operator interface module. The microprocessor module 64 receives regulated five volt power from the power input module 63, and filters this power at each major device by capacitors C7 and C8 to reduce transients. The microprocessor chip U2 contains the central processing unit, performs all calculations and processes the input and output signals related to timing between cigarettes, display of messages, programming from the keypad, operation of the cigarette dispensing and cover latch solenoids, and sounding of the beeper. It also contains the sequencing and instructions in permanent memory, an intermediate storage area used in processing, and input and output operations. The frequency of oscillation is paced by an on-board oscillator which, in turn, is controlled by a twelve megahertz crystal Y1 and capacitors C5 and C6.

A power monitor chip U3 provides a clean starting signal for the microprocessor to start operation when power is first applied, and insures that the processor only operates when adequate power is supplied. It continually monitors the processor operation and supply voltage level, and if necessary restarts it to reduce the risk of malfunction. A local push button switch S1 is used during initial manufacturing tests and as a diagnostic tool for trouble shooting.

The memory and clock module 65 is supplied with regulated five volt power from the power input module, and this energy is filtered at each major device by capacitors C10 and C11 to reduce transients.

Flash memory chip U4 stores the sequence of timing between cigarettes and also stores the encouraging messages. It communicates with the microprocessor on port P3 on a common clocked serial communication channel. Line P36 carries the clocking signal and line P37 contains the serial data signal. Line P30 provides write protection for this chip in the event of inadvertent transient signals on the clock and data lines. It disables write commands to the memory based on a hardware signal from the microprocessor. Line P35 carries programming timing information, and line P31 carries programming address information.

Real-time clock chip U5 keeps the data and time, and an alarm can be set to periodically interrupt the microprocessor 64 when the next action is required, such as when it is time for the next cigarette to be dispensed. It contains an on-board oscillator which regulates the seconds, minutes, and hours. The frequency of oscillation is controlled by a 32.768 kilohertz crystal Y2 and capacitor C9. It communicates with the microprocessor on port P3 on the same common clock serial communication channel used by the FLASH memory chip U4. Line P36 carries the clocking signal, and line P37 contains the serial data signal. This chip is initialized by the microprocessor on line P34. This chip interrupts the microprocessor on line P32 when the next action is required.

Power to several of the circuits in this module is supplied by the power input module. The keypad 21 contains twelve momentary contact push buttons connected to port P1. The three columns of push buttons are strobed by lines P14, P15 and P16. The data nibbles from the four push buttons in each column are transferred to the microprocessor on lines P10, P11, P12 and P13. The combined signal from all seven lines determines which, if any, push button on the keypad is being pressed.

The liquid crystal display 20 and driver can show up to four lines of twenty characters each, and is connected to ports P0 and P2 of the microprocessor. Port P0 carries the commands and characters from the microprocessor to the display in standard ASCII format. These characters include the date and time of day, encouraging messages, and menus for keypad programming. The communication is controlled by the microprocessor by means of port P2. Line P22 synchronizes and enables communications between the microprocessor and the display. Line P20 determines the type of data on port P0, i.e., either commands to format the display or characters to show on the display as part of the time, message, or menu. Line P21 sets the direction of data transfer between the microprocessor and display.

Solenoid 45 is activated at the appropriate time to dispense a cigarette, or if the storage compartment is empty, solenoid 35 is activated to unlatch the cover so that a new supply of cigarettes can be loaded. Power is supplied to the dispensing solenoid 45 at a controlled rate through diode D4 and resistor R3, and energy is stored in capacitor C12 until needed to operate the solenoid. The timing of solenoid 45 is actually controlled by transistor Q2 which is fired and powered by the biasing circuit Q1 and R2. The signal to activate the solenoid comes from the microprocessor via port P2 and line P23. When the solenoid 45 is energized, it ejects a cigarette through the opening 22 and cover 23 so that the cigarette may be withdrawn by the smoker.

When the storage compartment is empty, the spring follower 51 closes the contact 60 to energize the latch solenoid 35 to open the cover so that the storage compartment may be replenished with cigarettes.

A beeper 46 is activated by the microprocessor via port P2 and line P24 whenever a cigarette is dispensed. This beeper provides a different sound when the storage compartment is empty and the contact 60 is closed. It also chirps to provide audible feedback when the key pad is used. Power to the beeper is controlled by transistors Q3 and Q4, and resistor R4.

There are four states of power supply for the unit: (1) power off; (2) adaptor power with no batteries installed; (3) adaptor power with batteries installed; and (4) battery power. The unit is "off" when no batteries are installed and no adaptor is plugged in. The unit can be turned "on" either by installing batteries or by plugging in the adaptor. If the unit is running on batteries and the adaptor is plugged in, the unit will switch to adaptor power. If the unit is running on the adaptor and is unplugged, it will either revert to battery power, if available, or turn "off". Batteries can be installed while running on the adaptor without affecting the operation of the unit.

There are five major states of operation for the dispenser of the invention: (1) timing until the next cigarette to be dispensed; (2) cigarette ready to be dispensed; (3) cigarette being dispensed; (4) storage cover unlocked; and (5) storage cover open. In the first three states, there are at least some cigarettes in the storage compartment, while in the last two states, the storage compartment is empty. Under normal circumstances, the unit will be timing until a next cigarette is to be dispensed. During this time the keypad and display can be used to view the date and time, to view encouraging messages, or to enter new messages, or extend the time between cigarettes if in manual mode, or to enter a sleep cycle time or delay time. This state ends when the timer times out and a cigarette is ready to be dispensed. The beeper 46 emits a signal when the unit is progressing to the next state, with a cigarette ready to be dispensed.

When a cigarette is ready to be dispensed, the smoker can withdraw the cigarette by grasping the end extended through opening 22, and/or can use the keypad to display a message or to program different times. After the cigarette is withdrawn, the unit goes back to its normal state, timing until a next cigarette is ready to be dispensed. However, if the cigarette withdrawn is the last cigarette in the dispenser, the unit beeps a different sound and unlocks the storage compartment cover.

While particular embodiments of the invention have been illustrated and described in detail herein, it should be understood that various changes and modifications may be made to the invention without departing from the spirit and intent of the invention as defined by the scope of the appended claims.

What is claimed is:

1. A timed cigarette dispenser, comprising:

a housing having means defining a storage compartment for cigarettes therein;

dispensing means in said housing for dispensing one cigarette at a time from the housing for access externally of the housing so that the cigarette may be grasped and withdrawn from the housing, said depensing means including a dispensing solenoid operative to extend a plunger to engage a cigarette in said dispenser to extend at least a portion of said cigarette outside of said housing where it may be grasped and withdrawn;

timer means for timing the interval between cigarettes dispensed from the housing, said dispensing means being responsive to said timer means to dispense a cigarette at the end of predetermined time intervals set by the timer means;

covering means covering and closing said storage compartment to prevent access to any cigarettes in said dispenser other than the single cigarette dispensed at the end of the predetermined time intervals;

latch means engaged with said cover means to keep said cover means closed when cigarettes are present in said storage compartment;

means to release said latch means to permit said cover means to be opened to gain access to said storage compartment when the storage compartment is empty of cigarettes, whereby the storage compartment may be refilled with cigarettes;

said dispensing means, timer means, and latch means being electronically controlled.

2. A timed cigarette dispenser as claimed in claim 1, wherein:

latch means is engaged with said cover means to keep said cover means closed when cigarettes are present in said storage compartment; and means to release said latch means to permit said cover means to be opened to gain access to said storage compartment when the storage compartment is empty of cigarettes, whereby the storage compartment may be refilled with cigarettes.

3. A timed cigarette dispenser as claimed in claim 1, wherein:

said dispensing means, timer means, and latch means are electronically controlled.

4. A timed cigarette dispenser as claimed in claim 3, wherein:

said dispensing means includes a dispensing solenoid operative to extend a plunger to engage a cigarette in said dispenser to extend at least a portion of said cigarette outside of said housing where it may be grasped and withdrawn.

5. A timed cigarette dispenser as claimed in claim 3, wherein:

said latch means includes a latch member on said cover means, and a latch solenoid with a latch solenoid plunger positioned to extend into an opening in said latch member to hold the latch member and thus the cover in a closed position over said storage compartment.

6. A timed cigarette dispenser as claimed in claim 1, wherein:

said means to release the latch means includes a switch means responsive to emptying of cigarettes from said storage compartment, said switch means being operatively connected with said latch solenoid to energize said latch solenoid and retract said latch solenoid plunger from the latch member to permit the cover to be opened when the storage compartment is empty of cigarettes.

7. A timed cigarette dispenser as claimed in claim 4, wherein:

said latch means includes a latch member on said cover means, and a latch solenoid with a latch solenoid plunger positioned to extend into an opening in said latch member to hold the latch member and thus the cover in a closed position over said storage compartment; and said means to release the latch means includes a switch means responsive to emptying of cigarettes from said storage compartment, said switch means being operatively connected with said latch solenoid to energize said latch solenoid and retract said latch solenoid plunger from the latch member to permit the cover to be opened when the storage compartment is empty of cigarettes.

8. A timed cigarette dispenser comprising:

a housing having means defining a storage compartment for cigarettes therein;

dispensing means in said housing for dispensing one cigarette at a time from the housing for access externally of the housing so that the cigarette may be grasped and withdrawn from the housing;

timer means for timing the interval between cigarettes dispensed form the housing, said dispensing means being responsive to said timer means to dispense a cigarette at the end of predetermined time intervals set by the timer means;

covering means covering and closing said storage compartment to prevent access to any cigarettes in said dispenser other than the single cigarette dispensed at the end of the predetermined time intervals;

latch means engaged with said cover means to keep said cover means closed when cigarettes are present in said storage compartment, said latch means including a latch member on said cover means, and a latch solenoid with a latch solenoid plunger positioned to extend into an opening in said latch member to hold the latch member, and thus the cover, in a closed position over said storage compartment;

means to release said latch means to permit said cover means to be opened to gain access to said storage compartment when the storage compartment is empty of cigarettes, whereby the storage compartment may be refilled with cigarettes;

said dispensing means, timer means, and latch means being electronically controlled.

9. A timed cigarette dispenser as claimed in claim 8, wherein:

said video display comprises a liquid crystal display.

10. A timed cigarette dispenser comprising:

a housing having means defining a storage compartment for cigarettes therein;

dispensing means in said housing for dispensing one cigarette at a time from the housing for access externally of the housing so that the cigarette may be grasped and withdrawn from the housing, said dispensing means including a dispensing solenoid opertive to extend a plunger to engage a cigarette in said dispenser to extend at least a portion of said cigarette outside of said housing where it may be grasped and withdrawn;

covering means covering and closing said storage compartment to prevent access to any cigarettes in said dispenser other than the single cigarette dispensed at the end of the predetermined time intervals;

latch means engaged with said cover means to keep said cover means closed when cigarettes are present in said storage compartment, said latch means including a latch member on said cover means, and a latch solenoid with a latch solenoid plunger positioned to extend into an opening in said latch member to hold the latch member, and thus the cover, in a closed position over said storage compartment;

means to release said latch means to permit said cover means to be opened to gain access to said storage compartment when the storage compartment is empty of cigarettes, whereby the storage compartment may be refilled with cigarettes, said means to release the latch means including a switch means responsive to emptying of cigarettes from said storage compartment, said switch means being operatively connected with said latch solenoid to energize said latch solenoid and retract said latch solenoid plunger from the latch member to permit the cover to be opened when the storage compartment is empty of cigarettes.

11. A timed cigarette dispenser as claimed in claim 10, wherein:

said dispensing means includes a dispensing solenoid operative to extend a plunger to engage a cigarette in said dispenser to extend at least a portion of said cigarette outside of said housing where it may be grasped and withdrawn;

said latch means includes a latch member on said cover means, and a latch solenoid with a latch solenoid plunger positioned to extend into an opening in said latch member to hold the latch member and thus the cover in a closed position over said storage compartment; and said means to release the latch means includes a switch means responsive to emptying of cigarettes from said storage compartment, said switch means being operatively connected with said latch solenoid to energize said latch solenoid and retract said latch solenoid plunger from the latch member to permit the cover to be opened when the storage compartment is empty of cigarettes.

12. A timed cigarette dispenser as claimed in claim 1, wherein:

said dispensing means includes a dispensing chamber adjacent said storage compartment for receiving a single cigarette and holding it in a position ready to be dispensed.

13. A timed cigarette dispenser as claimed in claim 12, wherein:

said dispensing means includes a dispensing solenoid operative to extend a plunger to engage a cigarette in said dispensing chamber to extend at least a portion of said cigarette outside of said housing where it may be grasped and withdrawn.

14. A timed cigarette dispenser as claimed in claim 3, wherein:

said dispensing means includes a dispensing chamber adjacent said storage compartment for receiving a single cigarette and holding it in a position ready to be dispensed, and a dispensing solenoid operative to extend a plunger to engage a cigarette in said dispensing chamber to extend at least a portion of said cigarette outside of said housing where it may be grasped and withdrawn; and a spring means and follower are positioned to move the follower across the storage compartment to move cigarettes in the storage compartment toward and into the dispensing chamber as cigarettes are withdrawn at the end of dispensing cycles.

15. A timed cigarette dispenser as claimed in claim 14, wherein:

said latch means includes a latch member on said cover means, and a latch solenoid with a latch solenoid plunger positioned to extend into an opening in said latch member to hold the latch member and thus the cover in a closed position over said storage compartment;

said means to release the latch means includes a switch means responsive to emptying of cigarettes from said storage compartment, said switch means being operatively connected with said latch solenoid to energize said latch solenoid and retract said latch solenoid plunger from the latch member to permit the cover to be opened when the storage compartment is empty of cigarettes; and said switch means includes a contact in said housing engaged by said follower when the storage compartment is empty, to close a circuit and energize said latch solenoid to open the latch and permit the cover to be opened.

16. A timed cigarette dispenser as claimed in claim 15, wherein:

electronic circuit means is connected with said dispensing solenoid to energize the dispensing solenoid at the end of a predetermined time interval set by the timer means.

17. A timed cigarette dispenser as claimed in claim 16, wherein:

the electronic circuit means includes a microprocessor and keypad, said microprocessor being programmable from the keypad to change the time intervals set by the timer means.

18. A timed cigarette dispenser as claimed in claim 17, wherein:

said electronic circuit means includes an audible signal means to emit an audible signal when said timer means reaches the end of a predetermined time interval to dispense a cigarette, and to emit an audible signal when said storage compartment is empty of cigarettes.

19. A timed cigarette dispenser as claimed in claim 18, wherein:

said dispenser has a size and shape similar to that of an ordinary cigarette case, and is adapted to hold a full pack of cigarettes in all popular sizes of cigarettes.

* * * * *